United States Patent [19]

Temming

[11] 4,328,908

[45] May 11, 1982

[54] APPARATUS FOR DENESTING AND DELIVERING THE BOTTOM ONE OF A STACK OF TRAYS FOR EGGS

[75] Inventor: Leonardus J. Temming, Aalten, Netherlands

[73] Assignee: Staalkat B.V., Aalten, Netherlands

[21] Appl. No.: 113,124

[22] Filed: Jan. 17, 1980

[30] Foreign Application Priority Data

Jan. 22, 1979 [NL] Netherlands ..... 7900502

[51] Int. Cl.[3] ..... B65H 3/22

[52] U.S. Cl. ..... 221/213; 414/128

[58] Field of Search ..... 414/125, 126, 128; 221/213–216, 211

[56] References Cited

U.S. PATENT DOCUMENTS 3,341,072 9/1967 Van der Schoot ..... 221/251 X 3,407,965 10/1968 Kuhlman ..... 221/211 X

FOREIGN PATENT DOCUMENTS 997520 7/1965 United Kingdom ..... 221/213

*Primary Examiner*—F. J. Bartuska

*Attorney, Agent, or Firm*—Cushman, Darby & Cushman

[57] ABSTRACT

Apparatus for mechanically denesting and delivering the bottom one of a nested stack of trays for eggs of the like, each substantially consisting of a plane web portion and projections extending upwardly and downwardly from said web portion, which projections engage with each other during nesting. The apparatus is provided with a plurality of tray engaging members for pulling said bottom tray downwardly both by downwardly extending projections and its peripheral edge.

3 Claims, 2 Drawing Figures

Figure 1:
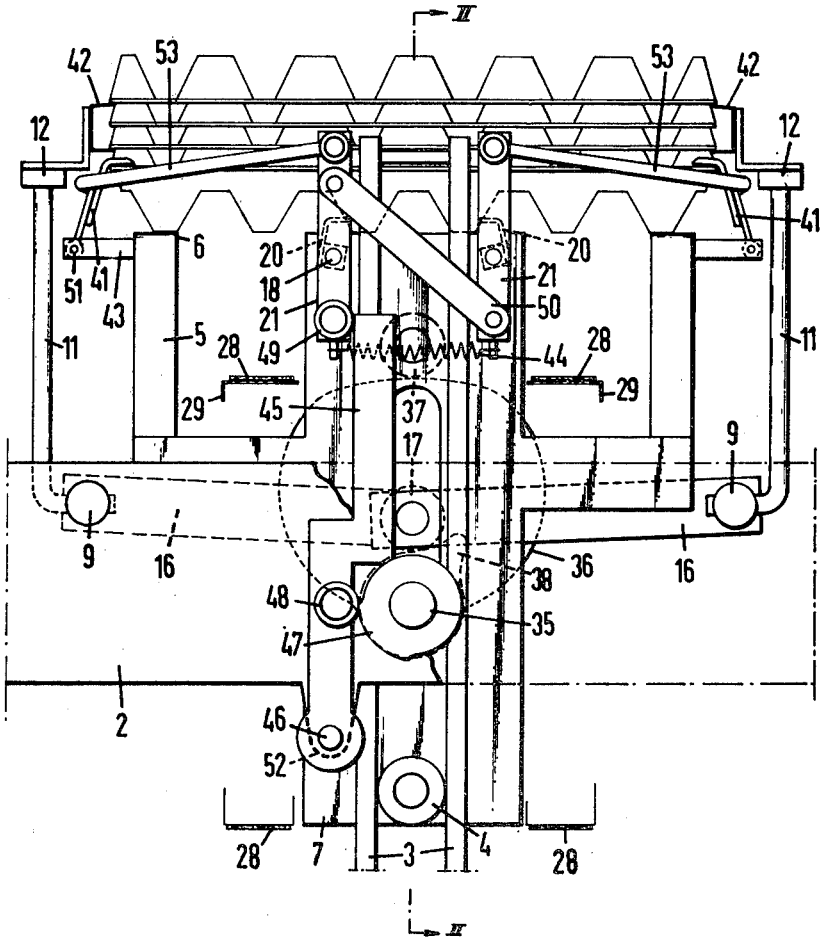

APPARATUS FOR DENESTING AND DELIVERING THE BOTTOM ONE OF A STACK OF TRAYS FOR EGGS

The invention relates to an apparatus for mechanically denesting and delivering the bottom one of a nested stack of trays for eggs or the like, each substantially consisting of a plane web portion and projections extending upwardly and downwardly from said web portion, which projections engage with each other during nesting, said apparatus comprising a table vertically movable up and down and carrying tray engaging members for engaging with downwardly extending projections of the bottom tray and for pulling the same downwardly, and on which table, just before it reaches its highest position, the nested stack comes to rest owing to the retraction of retaining members. In a similar apparatus, disclosed in applicants' Dutch Pat. No. 125,019 corresponding to U.S. Pat. No. 3,341,072, the retaining members consist of sharp-edged, wedge-shaped separating members, which are arranged, when the table with the stack resting thereon is stationary in its highest position, to be driven forcefully inwardly between the edges of the lowermost and the lowermost but one of the trays in the stack, in a plane located at a predetermined distance above the table top accurately in agreement with the height of the downwardly extending projections of the trays, thereby to release said edges from each other and force them apart. Practice has shown that when the trays are of poor quality and greatly wedged together the separating action of the wedge-shaped separating members is insufficient. The two lowermost trays are temporarily released from each other at the sides, but the tray engaging members insufficiently pull the bottom tray downwards in the center thereof to cause all the clamped and sometimes sticky tray portions to be separated from each other.

It is an object of the present invention to eliminate the disadvantage referred to and to provide an apparatus of great reliability.

For this purpose an apparatus of the kind defined above is characterized by a second set of tray engaging members rotatably connected to the table and arranged to engage with the peripheral edge of the tray to be released.

Preferably, if the control of the first set of tray engaging members is derived from the movement of the table, with these tray engaging members being mounted on two mutually parallel shafts located in the central part, and each provided at one end with two-armed operating levers interconnected by a spring, the apparatus is further characterized in that the tension spring acts on the lower arms of the operating levers and one of the said arms is provided with a follower roller capable of cooperating with a lever pivoted to a bearing pin fixedly connected to the frame, and which lever is also provided with a follower roller capable of cooperating with a cam rotatably connected to the frame and driven by a motor, the opposite operating lever being movable in opposite direction via a diagonal rod.

In a further elaboration of the invention, the operation of the second set of tray engaging members can be materialized in that each of the upper arms of the operating levers is pivoted to a lever, the other end of which is pivoted to one of the second tray-engaging members. Preferably the latter are hook-shaped. The operation of the two sets of tray engaging members is thus effected simultaneously and in coupled fashion.

Figure 2:
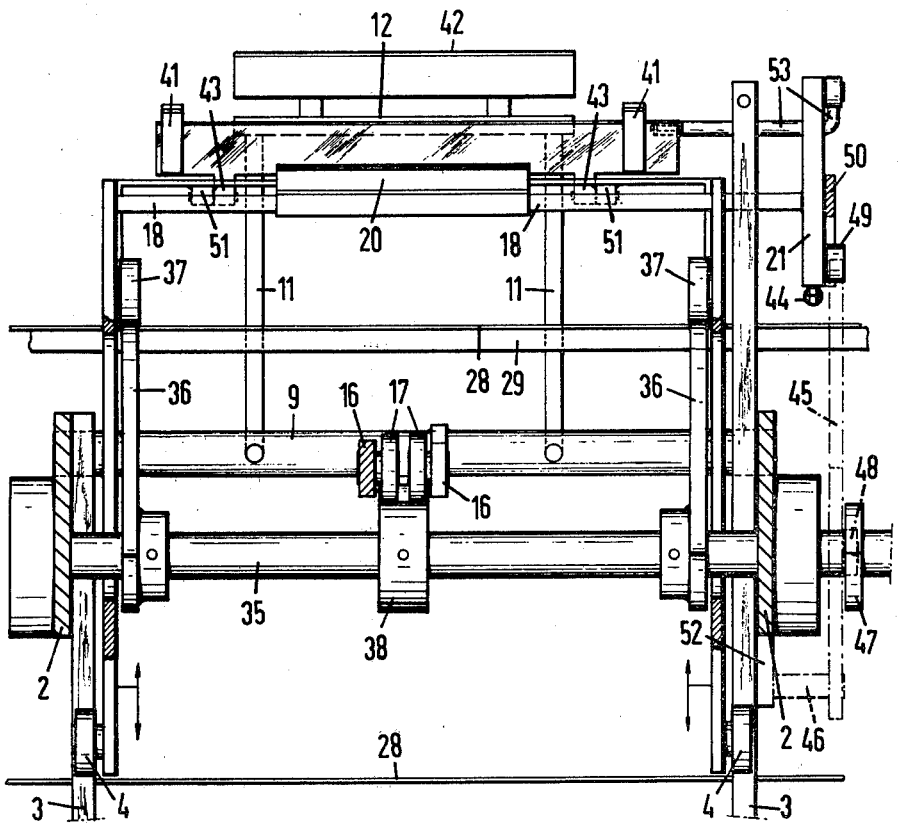

In illustration of the invention, one embodiment of the denester will now be described, by way of example, with reference to the accompanying drawings, in which:

FIG. 1 shows a longitudinal sectional view of a denester according to the present invention; and FIG. 2 shows a cross-sectional view, taken on the line II—II of FIG. 1.

Referring to the drawings, in which parts corresponding to those of the embodiment shown in Dutch Pat. No. 125,019 are designated by the same reference numerals, a denester is provided with legs, not shown, and a frame 2 resting thereon. This frame comprises two guide frames 3, each forming a vertical slot, and constituting a guide for a table 5 mounted for up and down movement relative to frame 2 by means of travelling rollers 4. The table comprises two carrying frames 6, supported at each of the ends by an end plate comprising a central portion 7 mounting travelling rollers 4. Carrying frames 6 are positioned so that on each thereof a row of downwardly extending projections can rest of a bottom tray of a stack of such trays, which stack is guided against lateral movement by guide rods, not shown, provided on frame 2.

Mounted in frame 2, parallel to carrying frames 6, are shafts 9 carrying approximately vertical rods 11 for supporting a bridge 12. Connected to each bridge 12 is a retaining member 42. The length of rods 11 has been selected so, or can be adjusted so that when a stack of trays has been placed on carrying frames 6 which are in the uppermost position, the legs of the U-shaped retaining members 42 can be moved accurately between the slots of successive trays.

The two bridges 12 are interconnected by at least one tension spring not shown. Each shaft 9 is additionally provided with a lever 16 carrying at its end a follower roller 17, the purpose of which will be described hereinafter.

Mounted in the top of central portion 7 of the two end plates of table 5, also parallel to carrying frames 6, are two shafts 18, on each of which a row of tray engaging members 20 are mounted by means of blocks not shown, said tray engaging members having sharp points pointing in the direction of the tray engaging members of the other set. Shafts 18 and the tray engaging members 20 mounted thereon are positioned or dimensioned so that the tray engaging members when moved towards each other so firmly engage one or more downwardly extending projections of a tray resting on carrying frames 6, by their points, as to be capable of exerting a force on the lowermost tray of a nested stack thus engaged during the downward movement of table 5.

On at least one end of shafts 18 there are provided operating levers 21 having two arms, one of which extends upwardly and the other downwardly. The downwardly extending arms of levers 21 are interconnected by a tension spring 44.

The lower arm of the left-hand operating lever 21 is further provided with a follower roller 49 arranged to cooperate with a lever 45, pivoted to a bearing pin 46 fixedly connected to a projection 22 of the frame. Lever 45 is also provided with a follower roller 48, arranged to cooperate with a cam 47 which is secured to a main shaft 35 (in FIG. 2 cam 47 and roller 48 have been omitted for the sake of clarity).

During the upward movement of table 5 with the central portion 7 levers 21 will be operated by means of follower rollers 49 by lever 45, the pattern of movement of which is determined by the cooperation between roller 48 and cam roller 47.

Table 5 is further provided with outwardly extending supports 43, the free ends of which are each provided with a hinge 51 on which a hook-shaped tray engaging member 41 acts. The hook-shaped member 41 is further pivoted to a lever 53, the other end of which is pivoted to the upper arm of operating lever 21. In this way, simultaneously with the engagement by tray engaging member 20 of the central bottom portion of a tray the two tray engaging members 41 will be moved inwardly between the lowermost and the lowermost but one of the trays. This position of the tray engaging members 41 is maintained during a downward movement of the table, whereby it is ensured that the "release" of the bottom tray is effected not only by tray engaging members 20, but also by the tray engaging members 41, i.e. the tray is released as a consequence of a downwardly directed force exerted on the bottom tray both in the central portion thereof and along its edges. Thus during each cycle the bottom tray is engaged by the tray engaging members 20 and 41, moved downwardly along with a table 5, and deposited on conveyor belts 28, which are movable over a carrying beam 28 extending horizontally and parallel to carrying frames 6.

Mounted on the main shaft 35 are two cam discs 36, which can cooperate with rollers 37 journalled in the central portion 7 of the end plates of table 5 for moving said table upwardly and downwardly. Shaft 35 further mounts a cam disc 38 which cooperates with the earlier described follower rollers 17 for moving apart retaining members 42.

The apparatus is driven by an electric motor not shown, which may be circuited so that it starts upon receipt of a pulse given by a packaging machine when there is a need for a tray to be denested by the apparatus and to be supplied to the packaging machine. The motor will then drive conveyor belts 28, by means of a drive belt and pulley not shown, and at the same time, by means of a gear not shown, rotate the main shaft 35. The motor may be circuited so that after completion of a full revolution by main shaft 35 it is automatically switched off.

What I claim is:

1. Apparatus for mechanically denesting and delivering the bottom one of a nested stack of trays for eggs or the like, each including a plane web portion and projections extending upwardly and downwardly from said web portion, which projections engage with each other during nesting, said apparatus comprising a table vertically movable up and down relative to a frame and carrying tray engaging members for engaging with downwardly extending projections of the bottom tray and for pulling the same downwardly, and on which table, just before it reaches its highest position, the nested stack comes to rest owing to the retraction of retaining members, control of the first set of tray engaging members being derived from the movement of the table, with these tray engaging members being mounted on two mutually parallel shafts located in the central part, and each provided at one end with two-armed operating levers interconnected by a tension spring which acts on the lower arms of the operating levers, one of said arms being provided with a follower roller capable of cooperting with a lever pivoted to a bearing pin fixedly connected to the frame, which lever is also provided with a follower roller capable of cooperating with a cam rotatably connected to the frame and driven by a motor, the opposite operating lever being movable in opposite direction via a diagonal rod, and a second set of tray engaging members rotatably connected to the table and arranged to engage with the peripheral edge of the tray to be released.

2. Apparatus as claimed in claim 1, wherein the upper arms of the operating levers are each pivoted to a lever, the other end of which is pivoted to one of said second tray-engaging members.

3. Apparatus as in claim 2 wherein said second tray-engaging members ae hook-shaped.

* * * * *